US008485520B2

(12) United States Patent
Nakano

(10) Patent No.: US 8,485,520 B2
(45) Date of Patent: Jul. 16, 2013

(54) SHEET STACKING APPARATUS WITH SKEW VALUE SENSOR FOR SHEET STACK DESIGNATION

(75) Inventor: Toshiki Nakano, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/413,856

(22) Filed: Mar. 7, 2012

(65) Prior Publication Data

US 2012/0235352 A1 Sep. 20, 2012

(30) Foreign Application Priority Data

Mar. 16, 2011 (JP) ..... 2011-058320

(51) Int. Cl.
*B65H 43/00* (2006.01)

(52) U.S. Cl.
USPC ..... 271/176; 271/288; 271/303

(58) Field of Classification Search
USPC ..... 271/288, 298, 303, 176
See application file for complete search history.

(56) References Cited

U.S. PATENT DOCUMENTS

2002/0113366 A1* 8/2002 Watanabe et al. ..... 271/315

FOREIGN PATENT DOCUMENTS

JP 06191705 A * 7/1994
JP 2009-061425 A 3/2009

* cited by examiner

*Primary Examiner* — Gerald McClain
(74) *Attorney, Agent, or Firm* — Posz Law Group, PLC

(57) ABSTRACT

According to one embodiment, a sheet stacking apparatus comprises a conveyance path, a plurality of stackers, a plurality of gates, a skew sensor, and a control unit. The gates are arranged in a number corresponding to the number of stackers, and guide the sheets from the conveyance path into the stackers, respectively. The skew sensor detects the skew of the sheet conveyed along the conveyance path. The control unit drives a gate corresponding to a stacker, in which the sheet is to be stacked, in accordance with the skew value of the sheet detected by the skew sensor upstream of the gate corresponding to the stacker, in which the sheet is to be stacked, in the direction in which the sheet is conveyed along the conveyance path.

13 Claims, 9 Drawing Sheets

SHEET STACKING APPARATUS WITH SKEW VALUE SENSOR FOR SHEET STACK DESIGNATION

CROSS-REFERENCE TO RELATED APPLICATIONS

This application is based upon and claims the benefit of priority from prior Japanese Patent Application No. 2011-058320, filed Mar. 16, 2011, the entire contents of which are incorporated herein by reference.

FIELD

Embodiments described herein relate generally to a sheet stacking apparatus.

BACKGROUND

A sheet processing apparatus such as a mail sorting machine includes a stacking unit as a paper sheet stacking apparatus which stacks sheets sorted into a plurality of sorting destinations. The stacking unit includes a plurality of stackers associated with the plurality of sorting destinations, respectively, and a conveyance mechanism which conveys sheets into each stacker. The stacking unit conveys each sheet received from the main body of the sheet processing apparatus into a stacker corresponding to the sorting destination of this sheet. However, the stacking unit of the conventional sheet processing apparatus cannot detect any skew that occurs during conveyance in the stacking unit. In the conventional sheet processing apparatus, problems may occur in a process of stacking sheets in the stackers due to a skew that occurs during conveyance in the stacking unit.

DETAILED DESCRIPTION

In general, according to one embodiment, a sheet stacking apparatus comprises a conveyance path, a plurality of stackers, a plurality of gates, a skew sensor, and a control unit. The conveyance path conveys sheets. The plurality of stackers stack the sheets. The plurality of gates are arranged in a number corresponding to the number of stackers, and guide the sheets from the conveyance path into the stackers, respectively. The skew sensor detects the skew of the sheet conveyed along the conveyance path. The control unit drives a gate corresponding to a stacker, in which the sheet is to be stacked, in accordance with the skew value of the sheet detected by the skew sensor upstream of the gate corresponding to the stacker, in which the sheet is to be stacked, in the direction in which the sheet is conveyed along the conveyance path.

Embodiment will be described below with reference to the accompanying drawings.

A paper sheet processing apparatus as a sheet processing apparatus according to the embodiment processes a paper sheet as a sheet. A paper sheet processing apparatus includes a stacking unit serving as a paper sheet stacking apparatus which stacks the processed paper sheet. The stacking unit serving as a paper sheet stacking apparatus according to the embodiment includes a plurality of stackers which stack paper sheets. The paper sheet processing apparatus is assumed to be, for example, a mail sorting machine which sorts pieces of mail (postcard, letter, envelope) as paper sheets in accordance with their destination information (sorting information) including, for example, their addresses and zip codes.

The paper sheet stacking apparatus according to the embodiment can be used as, for example, a stacking unit in a mail sorting machine. The mail sorting machine reads an image of mail using a scanner to recognize its destination information including, for example, its address and zip code from the image of the read paper sheet. The mail sorting machine, uses, as sorting information for delivery, the destination information that can be recognized from the read image. The mail sorting machine associates each stacker in the stacking unit with the destination information (sorting information for delivery). The mail sorting machine determines a stacker serving as the sorting destination of the mail based on the recognition result of the destination information. The stacking unit of the mail sorting machine conveys the paper sheet into the stacker serving as the sorting destination and stacks it in this stacker. In the mail sorting machine, the stacking unit often includes from several ten to several hundred stackers. The larger the number of stackers, the longer the distance across which paper sheets are conveyed in the stacking unit in the mail sorting machine.

Figures 1A, 1B:
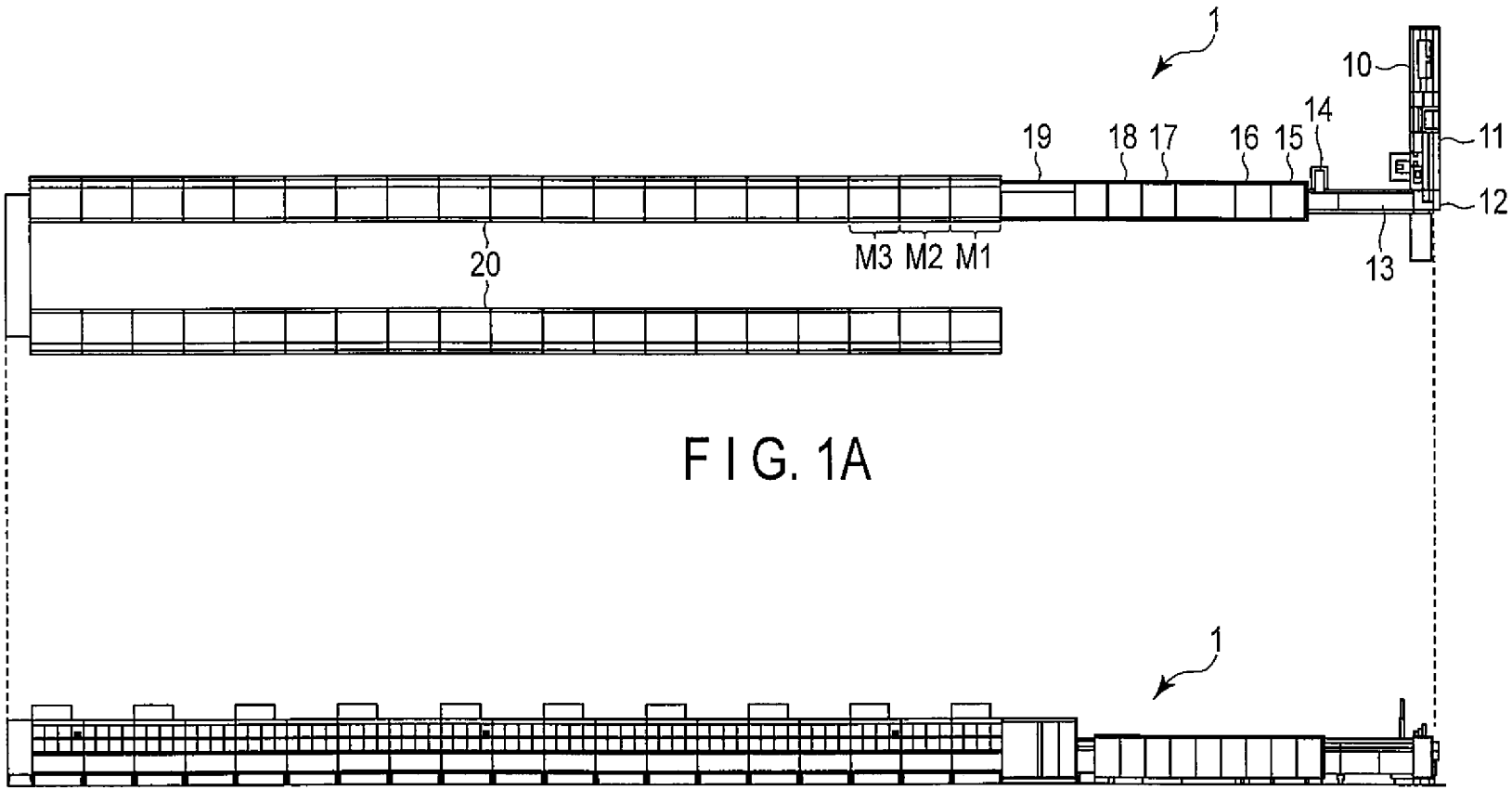
FIGS. 1A and 1B show overall views of a paper sheet processing apparatus including a paper sheet stacking apparatus according to the embodiment.

FIGS. 1A and 1B illustrate an example of the configuration of a paper sheet processing apparatus 1 according to the embodiment. FIG. 1A illustrates an example of the configuration of various modules in the paper sheet processing apparatus 1. FIG. 1B illustrates an example of the external configuration of the paper sheet processing apparatus 1, shown in FIG. 1A, when viewed from the side. The paper sheet processing apparatus 1 shown in FIGS. 1A and 1B is assumed to be, for example, a mail sorting machine which sorts pieces of mail (for example, postcards, letters, or sealed letters) based on the sorting information serving as their destination information including, for example, their addresses and zip codes.

In the configuration example shown in FIG. 1A, the paper sheet processing apparatus 1 includes processing modules such as an operation panel 10, supply unit 11, pickup unit 12, conveyance unit 13, rejection unit 14, pre-barcode reading unit 15, character recognition unit 16, printing unit 17, verify barcode reading unit 18, branching unit 19, and stacking unit 20. The paper sheet processing apparatus 1 also includes a control system including control units which individually control the operations of the respective modules, and a control unit which systematically controls the control units for these modules.

The operation panel 10 functions as a user interface. The operation panel 10 includes an operation unit and display unit. The operation panel 10 uses, for example, a display including an internal touch panel as the operation unit. Alternatively, the operation panel 10 may use, for example, a keyboard as the operation unit, and a display as the display unit.

The operation panel 10 serving as the operation unit accepts input of various operations by the operator. The operation panel 10 sends a signal indicating the input operation details to the control unit. The operation panel 10 serving as the display unit displays a screen generated by the control unit. The operation panel 10 displays, for example, various operation guides and processing results to the operator.

The supply unit 11 stocks paper sheets S to be processed. The supply unit 11 is set while a plurality of paper sheets to be sorted are stacked. A paper sheet S to be sorted is assumed to have a first surface on which a character string indicating the sorting destination is written. The character string indicating the sorting destination may be, for example, that indicating the destination including the address and zip code. The paper sheets S are set in the supply unit 11 while, for example, their trailing edges are aligned so that their first surfaces are oriented in the same direction. The supply unit 11 sequentially supplies the paper sheets S to the pickup unit 12 placed at the pickup position.

The pickup unit 12 picks up the paper sheets S, set in the supply unit 11, one by one at a predetermined interval. The pickup unit 12 supplies the paper sheets S picked up from the supply unit 11 to a conveyance path provided in the conveyance unit 13. The pickup unit 12 includes a separation roller. The separation roller is placed in contact with the paper sheet S present at, for example, the end (pickup position) of the supply unit 11. The separation roller rotates to feed the paper sheets S, set in the supply unit 11, one by one to the conveyance unit 13 from the end of the supply unit 11 in the direction in which the paper sheets S are stacked. The separation roller can feed one paper sheet S every time, for example, it rotates through 360°.

The conveyance unit 13 includes a conveyance path for conveying the paper sheets S to each unit in the paper sheet processing apparatus 1. The conveyance unit 13 includes, for example, conveyor belts and driving pulleys. The conveyance unit 13 drives the driving pulleys using driving motors. The conveyor belts operate by the driving pulleys. The conveyance unit 13 conveys the paper sheets S, fed by the separation roller of the pickup unit 12, using the conveyor belts at a constant speed.

The paper sheet processing apparatus 1 also includes a plurality of sensors and a plurality of gates placed in the conveyance path. The control system for the paper sheet processing apparatus 1 sequentially controls the gates in accordance with the processing result obtained by each module to switch the conveyance destination of the paper sheet S conveyed along the conveyance path.

The rejection unit 14 is placed in the conveyance path of the conveyance unit 13. The rejection unit 14 detects a paper sheet S for which a subsequent process is impossible. The rejection unit 14 determines, for example, whether a subsequent process is possible for each paper sheet S. The rejection unit 14 includes a rejection stacking unit (not shown). The rejection stacking unit stacks a paper sheet S for which a subsequent process is determined to be impossible (a paper sheet S determined to be rejected).

The rejection unit 14 includes a length detection unit, thickness detection unit, and hardness detection unit. The length detection unit detects the length of a paper sheet S in the direction in which the paper sheet S is conveyed. The rejection unit 14 detects a paper sheet S having a length that falls outside a specification range (a paper sheet S that cannot be processed) using the length detection unit. The thickness detection unit detects the thickness of a paper sheet S. The rejection unit 14 detects a paper sheet S having a thickness that falls outside a specification range (a paper sheet S that cannot be processed). The hardness detection unit detects the hardness of a paper sheet S. The rejection unit 14 detects a paper sheet S having a hardness that falls outside a specification range (a paper sheet S that cannot be processed). The rejection unit 14 rejects a paper sheet S detected to have a length, thickness, or hardness that falls outside the specification range.

The rejection unit 14 also includes a foreign substance detection unit, metal detection unit, state detection unit, and overlapping detection unit. The foreign substance detection unit detects a paper sheet S containing a foreign substance that may cause a problem in a subsequent process. The metal detection unit detects a paper sheet S containing a metal that may cause a problem in a subsequent process. The state detection unit detects a paper sheet S having a shape and conveyed state that may cause a problem in a subsequent process. The overlapping detection unit detects a plurality of paper sheets S conveyed together while they overlap each other.

The rejection unit 14 rejects a paper sheet detected to contain a foreign substance by the foreign substance detection unit, that detected to contain a metal by the metal detection unit, that detected to have a nonstandard shape by the state detection unit, that detected to have an abnormal conveyed state by the state detection unit, or those detected to overlap each other.

The pre-barcode reading unit 15 reads a barcode attached in advance to the paper sheet S conveyed along the conveyance path. The pre-barcode reading unit 15 converts the read barcode into information indicating the sorting destination. The pre-barcode reading unit 15 sends the information (sorting information) indicating the sorting destination obtained from the read barcode to the control unit. The control unit determines the conveyance destination of the paper sheet S based on the sorting information received from the pre-barcode reading unit 15. The control unit controls each unit to stack the paper sheet S at the determined conveyance destination.

The character recognition unit 16 recognizes the characters written on the first surface of the paper sheet S conveyed along the conveyance path. The character recognition unit 16 reads an image on the first surface of the paper sheet S using a scanner to recognize the characters from the image read using the scanner. The character recognition unit 16 sends a character recognition result including the sorting information of the paper sheet S to the control unit. The control unit generates sorting information based on the character recognition result received from the character recognition unit 16 to determine a sorting destination corresponding to the sorting information.

Assume, for example, that the paper sheet S is mail having a first surface on which characters indicating its destination including, for example, its address and zip code are written. In this case, the character recognition unit 16 reads an image on the first surface of the mail using a scanner, and performs an OCR process for the scanned image, thereby recognizing its destination including, for example, its address and zip code written on the mail. The character recognition unit 16 sends a character recognition result including, for example, the address and zip code to the control unit as the destination information. The control unit determines the sorting destination of the mail based on the destination information received from the character recognition unit 16.

The printing unit 17 prints sorting information indicating the sorting destination on the paper sheet S. The printing unit 17 prints a barcode indicating the sorting information on the paper sheet S. Any barcode may be printed on the paper sheet S by the printing unit 17 as long as it can be read by the barcode reading units 15 and 18. The printing unit 17 prints, for example, a barcode indicating the sorting information on the paper sheet S using ink invisible to the naked eye. Note that the printing unit 17 may be configured to print a two-dimensional code as the barcode to be printed on the paper sheet S.

The verify barcode reading unit 18 reads an image including the barcode printed by the printing unit 17 from the paper sheet S. The verify barcode reading unit 18 converts the read barcode image into information. The verify barcode reading unit 18 sends the information obtained from the barcode to the control unit. The control unit determines the sorting destination (a corresponding stacker in the stacking unit 20) of the paper sheet S based on the sorting information received from the verify barcode reading unit 18.

The branching unit 19 sorts the paper sheets S based on the control of the control system. The branching unit 19 includes a plurality of gates which sort the paper sheets S. Each gate of the branching unit 19 sorts the paper sheet S into one of a plurality of row paths (to be described later) that communicate with the stackers of the stacking unit 20 (to be described later). That is, the control system for the paper sheet processing apparatus 1 controls the operation of each gate of the branching unit 19 based on the sorting information of the paper sheet S to send the paper sheet S to one of the plurality of row paths.

The stacking unit 20 includes a plurality of modules M (modules M1, M2, M3, . . . ). A stacking unit can be divided or added for each module so as to improve the productivity and the operating performance. Each module M includes a plurality of stackers which stack the paper sheets S. Each module M includes, for example, 4 (rows)×4 (columns)=16 stackers. The total number of stackers of the stacking unit 20 is equal to the total number of stackers of all the modules. The stacking unit 20 obtained by connecting n modules each including, for example, 4 (rows)×4 (columns) stackers to each other includes a total of 16×n stackers.

Each stacker is associated with the sorting information. In, for example, a mail sorting machine, a destination is assigned to each stacker as the sorting information so that pieces of mail as paper sheets are sorted in the order of delivery. Hence, as the number of groups into which paper sheets are sorted (that is, the number of stackers) increases, the number of modules which constitute the stacking unit 20 also increases.

The stacking unit 20 includes row paths for conveying the paper sheets S sorted by the branching unit 19 to each module M. In the stacking unit 20, the modules M are connected to each other for each row path (each row-specific conveyance path). The row paths serve as conveyance paths for conveying the paper sheets S into the stackers arranged in a matrix in each module. This means that the paper sheets S are conveyed along specific row paths (row paths into which the paper sheets S are sorted by the gates of the branching unit 19) in the stacking unit 20 including a plurality of modules connected to each other for each row path.

For example, when a large number of modules are used, the conveyance path (row path) in the stacking unit 20 often has a length as large as several ten meters. Also, the larger the length of the conveyance path (row path) in the stacking unit 20, the higher the possibility that a skew will be encountered in the conveyance path in the stacking unit 20.

The stacking unit 20 also includes a shift sensor or a skew sensor as a sensor P which detects a paper sheet S in the row path serving as the conveyance path. Sensors P are arranged in a number corresponding to the number of gates for guiding the paper sheets S from the row path into the stackers. The shift sensor outputs a detection signal indicating the presence/absence of a paper sheet S to the control system. The control system detects the leading and trailing edges of the conveyed paper sheet S at the detection position in the row path in accordance with the detection signal from the shift sensor.

The skew sensor detects the presence/absence of a paper sheet S and outputs a detection signal according to which the amount of skew of this paper sheet S is detected. The skew sensor uses, for example, two shift sensors aligned in a direction perpendicular to that in which the paper sheet S is conveyed along the row path. The skew sensor need only be capable of detecting the skew angle of the paper sheet S in the row path, and is not limited to a skew sensor which uses a plurality of shift sensors.

Note that when skew sensors are used as the sensors corresponding to all the gates (for example, all the shift sensors arranged in front of the respective gates are replaced with skew sensors), the structure in each module becomes complicated, leading to an increase in cost. Also, to control the gates in accordance with skew values detected by the skew sensors, it is necessary to ensure the processing time required to execute processes such as calculation of skew values and timing settings corresponding to the skew values. To ensure the above-mentioned processing time, a longer distance from each skew sensor to the corresponding gate needs to be ensured as the paper sheet S is conveyed along the row path of the stacking unit 20 at a higher speed. When a longer distance from each skew sensor to the corresponding gate is ensured, it becomes harder to downsize the stacking unit.

The stacking unit of the paper sheet processing apparatus according to the embodiment uses skew sensors as sensors corresponding to some gates instead of using skew sensors as sensors corresponding to all gates. In the configuration examples shown in FIGS. 3 and 4 (to be described later), skew sensors are arranged in one-to-one correspondence with the row paths in each module. With this arrangement, the stacking unit of the paper sheet processing apparatus according to the embodiment can suppress structure complication and increases in cost and size.

Also, in the stacking unit 20, gates are arranged in a number corresponding to the number of stackers. Each gate serves as a mechanism which receives, into the corresponding stacker, the paper sheet S conveyed along the row path of the stacking unit 20. The control system drives each gate at the timing at which the paper sheet S is received from the row path into the corresponding stacker. The gates operate by gate driving mechanisms. When each gate is turned on by the gate driving mechanism, it guides the paper sheet S conveyed along the row path into the corresponding stacker. The paper sheet S guided from the row path by each gate is received into the corresponding stacker by, for example, a receiving roller. The paper sheet S received into that stacker is sequentially stacked.

That is, the control system performs control to stack a paper sheet S having determined sorting information in a stacker corresponding to the sorting information in the stacking unit 20. In the branching unit 19, the control system uses each gate to sort the paper sheet S into a row path for conveying it into a stacker corresponding to the sorting information. In the stacking unit 20, the control system operates a gate corresponding to a stacker corresponding to the sorting information of the paper sheet S in accordance with the conveyance timing of the paper sheet S in the row path. Upon this operation, the paper sheet S sorted based on the sorting information is stacked in each stacker in the stacking unit 20.

The configuration of the control system for the paper sheet processing apparatus 1 will be described next.

Figure 2:
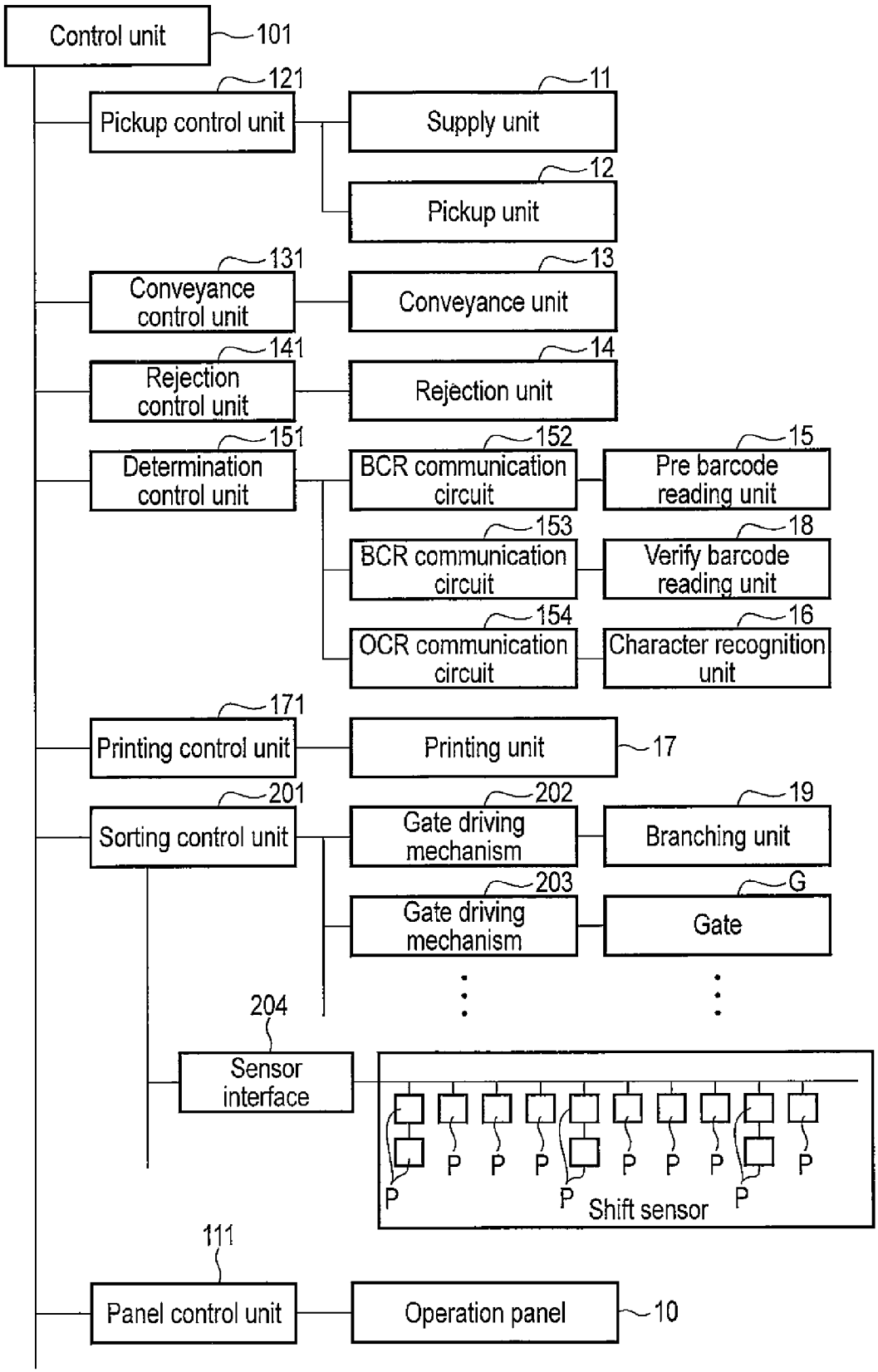
FIG. 2 is a block diagram illustrating an example of the configuration of a control system for the paper sheet processing apparatus.

FIG. 2 is a block diagram illustrating an example of the configuration of the control system for the paper sheet processing apparatus 1.

The paper sheet processing apparatus 1 includes a control unit 101 which controls the overall paper sheet processing apparatus 1. The paper sheet processing apparatus 1 also includes a panel control unit 111, pickup control unit 121, conveyance control unit 131, rejection control unit 141, determination control unit 151, printing control unit 171, and sorting control unit 201 as the configuration of the control system.

The control unit 101 systematically controls the operation of each unit in the paper sheet processing apparatus 1. The control unit 101 includes, for example, a CPU, buffer memory, program memory, and nonvolatile memory. The CPU performs various arithmetic processes. The buffer memory temporarily stores the results of the arithmetic processes performed by the CPU. The program memory and nonvolatile memory store, for example, various programs executed by the CPU, and various types of control data. The control unit 101 can perform various processes by causing the CPU to execute the programs stored in the program memory.

The panel control unit 111 controls the operation panel 10 which displays, for example, stacking information of the paper sheets S or abnormality information of the machine. Note that the operation panel 10 uses, for example, a display including an internal touch panel which allows information display and operation input.

The pickup control unit 121 controls the supply unit 11, and pickup unit 12. The pickup control unit 121 controls operations such as supply and pickup of the paper sheets S set in the supply unit 11.

The conveyance control unit 131 controls the conveyance unit 13.

The rejection control unit 141 controls a process of rejecting a paper sheet S by the rejection unit 14.

The determination control unit 151 determines the sorting information (for example, the destination including the address and zip code) of the paper sheet S. The determination control unit 151 supplies the sorting information of the paper sheet S to the control unit 101. The determination control unit 151 obtains the barcode reading result obtained by the pre-barcode reading unit 15, the recognition result of characters serving as sorting information obtained by the character recognition unit 16, or the barcode reading result obtained by the verify barcode reading unit 18. The determination control unit 151 determines the sorting information of the paper sheet S based on the information obtained from the pre-barcode reading unit 15, character recognition unit 16, or verify barcode reading unit 18.

The determination control unit 151 is connected to barcode reading unit (BCR) communication circuits 152 and 153 and a character recognition unit (OCR) communication circuit 154.

The BCR communication circuit 152 is connected to the pre-barcode reading unit 15. The BCR communication circuit 152 supplies, to the determination control unit 151, sorting information based on a barcode read by the pre-barcode reading unit 15. Also, the BCR communication circuit 153 is connected to the verify barcode reading unit 18. The BCR communication circuit 153 supplies, to the determination control unit 151, sorting information based on a barcode read by the verify barcode reading unit 18. Moreover, the OCR communication circuit 154 is connected to the character recognition unit 16. The OCR communication circuit 154 supplies, to the determination control unit 151, the recognition result of characters serving as sorting information obtained by an OCR process for an image on the paper sheet S read by the character recognition unit 16.

The printing control unit 171 controls printing by the printing unit 17. The printing control unit 171 causes the printing unit 17 to print a barcode indicating sorting information on the first surface of the paper sheet S.

The sorting control unit 201 controls conveyance of the paper sheet S in the branching unit 19 and stacking unit 20. The sorting control unit 201 is connected to gate driving mechanisms 202 and 203 and a sensor interface 204, as shown in FIG. 2. The sorting control unit 201 systematically controls the operation of each unit in the stacking unit 20 serving as a paper sheet stacking apparatus.

The sorting control unit 201 includes, for example, a CPU, buffer memory, program memory, and nonvolatile memory. The CPU performs various arithmetic processes. The buffer memory temporarily stores the results of the arithmetic processes performed by the CPU. The program memory and nonvolatile memory store, for example, various programs executed by the CPU, and various types of control data. More specifically, the program memory and nonvolatile memory store, for example, the setting time of the ON timing of each gate corresponding to a skew value, a tolerance for the skew value, and a calculation equation (function) for calculating a predicted skew value. An example of the nonvolatile memory is a rewritable nonvolatile memory.

The sorting control unit 201 can perform various processes by causing the CPU to execute the programs stored in the program memory. The sorting control unit 201 functions as, for example, a calculation unit by calculating a predicted skew value using an arithmetic process (to be described later). Also, the sorting control unit 201 includes a memory 201*a* which stores, for example, a skew value obtained from the detection result obtained by the skew sensor. The memory 201*a* uses, for example, a buffer memory or a nonvolatile memory.

The gate driving mechanism 202 drives the gates serving as the branching unit 19. The gate driving mechanism 202 operates the gates serving as the branching unit 19 based on the control of the sorting control unit 201 to sort the paper sheet S into each row path of the stacking unit 20.

The gate driving mechanisms 203 are provided to the gates corresponding to the respective stackers in the stacking unit 20. The gate driving mechanisms 203 operate the gates corresponding to the respective stackers. When each gate is driven by the gate driving mechanism 203, it guides the paper sheet S conveyed along the row path into the corresponding stacker.

The sensor interface 204 is connected to sensors (shift sensors PA001, PA002, PA003, PB001, . . . and skew sensors PA004, PB004, . . . ) in the stacking unit 20. Each sensor P outputs a detection signal indicating the detection result of the paper sheet S at the corresponding detection position to the sorting control unit 201 via the sensor interface 204. The sorting control unit 201 determines the position of the paper sheet S in the row path based on the detection signal from the sensor P. Also, the sorting control unit 201 detects the skew value of the paper sheet S based on the detection signal obtained by the skew sensor among the sensors P.

The configuration of the stacking unit 20 will be described next.

Figure 3:
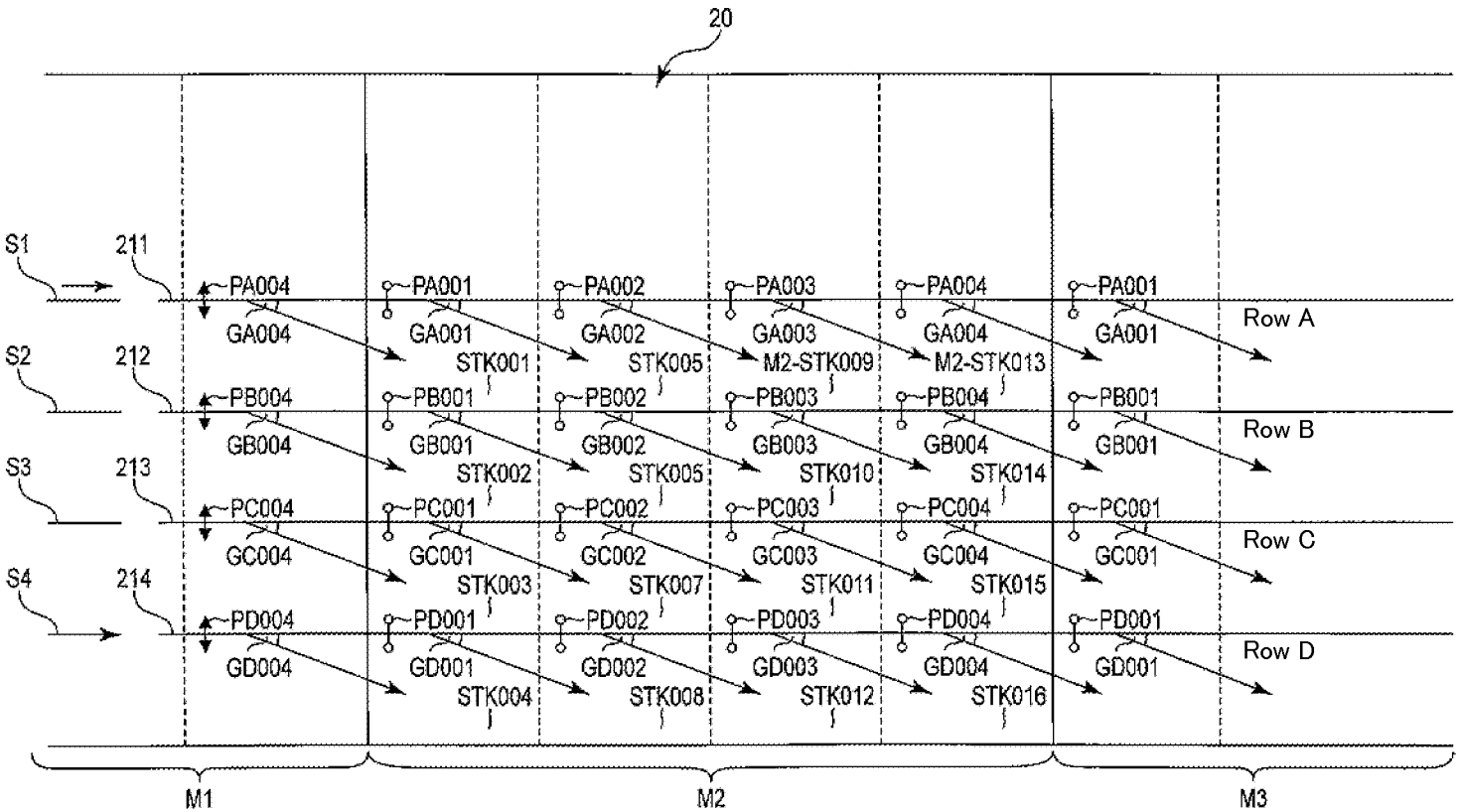
FIG. 3 is a view illustrating an example of the configuration of a stacking unit in the paper sheet processing apparatus.

FIG. 3 is a view illustrating an example of the configuration of the stacking unit 20.

In the configuration example shown in FIG. 3, the stacking unit 20 includes the first module M1, second module M2, third module M3, . . . . Each module M (modules M1, M2, M3, . . . ) includes a plurality of conveyance lines (row paths) 211, 212, 213, and 214, a plurality of stackers STK (stackers STK001, . . . ), a plurality of sensors P (sensors PA001, . . . ), and a plurality of gates G (gates GA001, . . . ), as shown in FIG. 3.

The plurality of conveyance lines (row paths) 211, 212, 213, and 214 include conveyor belts 211*a*, 212*a*, 213*a*, and 214*a*, respectively. The conveyor belts 211*a*, 212*a*, 213*a*, and 214*a* function as conveyance paths on the respective rows. The conveyor belts 211*a*, 212*a*, 213*a*, and 214*a* hold the paper sheets S while they stand upright. The conveyor belts 211*a*, 212*a*, 213*a*, and 214*a* operate in a predetermined direction using, for example, power which is produced by the motors and transmitted from the driving pulleys. The conveyor belts 211*a*, 212*a*, 213*a*, and 214*a* convey the paper sheets S in a predetermined conveyance direction while they stand upright in the corresponding row paths.

Each stacker STK serves as a sorting destination for a paper sheet S (S1, S2, S3, S4). Each stacker STK is associated with the sorting information. Each stacker STK stacks the paper sheet S sorted in accordance with the sorting information. Each stacker STK includes a backup plate. The backup plate applies a pressure to the paper sheet S to be stacked. The paper sheet S stacked in each stacker STK is clamped by the receiving roller and the backup plate. As a result, the paper sheet S received into each stacker is fixed in position so that it remains standing upright without falling.

In the configuration example shown in FIG. 3, the stackers STK are arranged in one-to-one correspondence with the sensors P and the gates G. Each sensor P is a shift sensor or a skew sensor. In the configuration example shown in FIG. 3, the shift sensors PA001, PA002, PA003, PB001, PB002, PB003, PC001, PC002, PC003, PD001, PD002, and PD003 are shift sensors. Each shift sensor serves to detect the position of the paper sheet S (the leading and trailing edges of the paper sheet S) in the row path.

Each of the shift sensors PA001, PA002, PA003, PB001, PB002, PB003, PC001, PC002, PC003, PD001, PD002, and PD003 outputs a detection signal indicating the presence/absence of a paper sheet S in the row path to the sorting control unit 201 via the sensor interface 204. Each shift sensor can use, for example, a transmissive sensor including a light emitter and a light receiver. Each shift sensor outputs a signal (detection signal) which changes from an ON state to an OFF state as the leading edge of the paper sheet S reaches the detection position. On the other hand, each shift sensor outputs a signal (detection signal) which changes from an OFF state to an ON state as the trailing edge of the paper sheet S passes through the detection position. The sorting control unit 201 detects the position of the paper sheet S in the row path based on the change in detection signal obtained by each shift sensor.

Also, in the configuration example shown in FIG. 3, the sensors PA004, PB004, PC004, and PD004 are skew sensors. Each skew sensor detects the amount of skew of the paper sheet S. Each skew sensor also serves to detect the position of the paper sheet S in the row path.

Each of the skew sensors PA004, PB004, PC004, and PD004 uses, for example, two shift sensors aligned in a direction perpendicular to that in which the paper sheet S is conveyed along the corresponding one of the row paths 211, 212, 213, and 214. Each skew sensor detects, for example, the leading edge (or trailing edge) of a non-skewed paper sheet S almost simultaneously (the difference between the detection timings falls within a predetermined range). Each skew sensor uses the two shift sensors to detect the leading edge (or trailing edge) of a skewed paper sheet S at different timings (the difference between the detection timings falls outside the predetermined range). That is, the sorting control unit 201 detects, as the amount of skew, the difference between the timings at which the two shift sensors which constitute each skew sensor detect the leading edge (or trailing edge) of the paper sheet S.

Moreover, in the configuration example shown in FIG. 3, skew sensors are provided in a number corresponding to the number of row paths in each module. In other words, in the modules shown in FIG. 3, the amount of skew is detected once in each row path. The sorting control unit 201 detects the paper sheet S conveyed along the row path 211, using, for example, the sensors PA001, PA002, PA003, and PA004 in this order. The sorting control unit 201 checks a skew in accordance with a detection signal obtained by the sensor PA004.

The gate G corresponding to each stacker STK is provided with the gate driving mechanism 203. Each gate driving mechanism 203 switches on/off the corresponding gate G. When each gate G is switched on, it guides the paper sheet S conveyed along the row path into the corresponding stacker STK. The paper sheet S guided from the row path by each gate G is received into the corresponding stacker STK by, for example, a receiving roller, and sequentially stacked. The gates G and gate driving mechanisms 203 have a configuration shown in, for example, FIG. 7 or 8 (to be described later). The sorting control unit 201 causes the gate driving mechanisms 203 to operate the gates G.

In the configuration example shown in FIG. 3, each module M (modules M1, M2, M3, . . . ) includes 16 stackers STK arranged on 4 rows (rows A, B, C, and D)×4 columns. Each module M includes conveyance lines (row paths) 211, 212, 213, and 214 on the respective rows of the stackers STK. In the example shown in FIG. 3, each module M includes the conveyance line (row path) 211 for row A, the conveyance line (row path) 212 for row B, the conveyance line (row path) 213 for row C, and the conveyance line (row path) 214 for row D. The conveyance lines (row paths) 211, 212, 213, and 214 use, for example, conveyor belts and conveyor rollers.

The row path 211 for row A serves as a conveyance line for conveying the paper sheets S into the stackers STK (for example, the stackers STK001, STK005, STK009, and STK013) on row A in the modules M. The row path 212 for row B serves as a conveyance line for conveying the paper sheets S into the stackers STK (for example, the stackers STK002, STK006, STK010, and STK014) on row B in the modules M. The row path 213 for row C serves as a conveyance line for conveying the paper sheets S into the stackers STK (for example, the stackers STK003, STK007, STK011, and STK015) on row C in the modules M. The row path 214 for row D serves as a conveyance line for conveying the paper sheets S into the stackers STK (for example, the stackers STK004, STK008, STK012, and STK016) on row D in the modules M.

The control unit 101 specifies a stacker STK serving as the sorting destination (stacking destination) of each paper sheet S based on, for example, the sorting information. The control unit 101 notifies the sorting control unit 201 of information indicating the stacker STK at the sorting destination of each paper sheet S. The sorting control unit 201 determines the row path in which the stacker STK at the sorting destination is placed. The sorting control unit 201 controls the gate of the branching unit 19 to sort the paper sheet S into the row path for conveying the paper sheet S into the stacker STK at the sorting destination. The sorting control unit 201 causes the gate provided in the stacker STK at the sorting destination to receive and stack the paper sheet S conveyed along the row path into the stacker STK at the sorting destination.

Also, before the conveyed paper sheet S reaches the gate G which guides it from the row path into the stacker STK at the sorting destination, the sorting control unit 201 drives the gate G. Upon such control, the sorting control unit 201 guides the paper sheet S from the row path into the stacker STK at the sorting destination. The sorting control unit 201 detects the position of the paper sheet S in the row path using the sensor P provided in this row path. The sorting control unit 201 controls driving of the gate corresponding to the stacker STK at the sorting destination based on a skew value (to be described later) and the detection result obtained by the shift sensors arranged in the row path.

When, for example, a paper sheet S1 is to be stacked on the stacker STK013 in the module M2, the sorting control unit 201 conveys it along the conveyance line 211 for row A. The sorting control unit 201 sets the gates GA001 and GA002 placed on the conveyance line 211 in an OFF state (disabled state), and sets the gate GA003 placed on the conveyance line 211 in an ON state (enabled state), thereby receiving, into the stacker STK013 the paper sheet S1 conveyed from the left to the right in FIG. 3 on the conveyance line 211 along row A.

The paper sheet processing apparatus 1 conveys a plurality of paper sheets at a predetermined interval. Hence, the stacking unit 20 may have a paper sheet (to be referred to as a preceding paper sheet hereinafter) conveyed on the same conveyance line 211 before the paper sheet S1. That is, if the sorting destination of the preceding paper sheet is not the stacker STK013, the gate GA003 cannot be turned on before the preceding paper sheet passes through the gate GA003. This means that the gate GA003 must be turned on in the period from when the preceding paper sheet reliably passes through it until the leading edge of the paper sheet S1 reaches it.

In the paper sheet processing apparatus 1, the interval at which successive paper sheets are conveyed is controlled so at least these paper sheets are not conveyed together. However, in practice, due to differences in, for example, shape or material quality, the interval between successive paper sheets being conveyed on the same conveyance path fluctuates. Hence, to reliably separate successive paper sheets and receive them into desired stackers, a given gate is driven at the timing at which the paper sheet to be received has reached a position as close to this gate as possible.

Note that in the configuration example shown in FIG. 3, the stacker STK is offset from the corresponding sensor P and gate G by one column to the downstream side in the direction in which the paper sheet S is conveyed. This is done because a path corresponding to stackers on one column is formed to guide the paper sheet S from the gate G into the stacker STK. However, the positions of the sensor P and gate G are not limited to those shown in FIG. 3. The positions of the sensor P and gate G corresponding to each stacker STK need only be set in accordance with, for example, the length of the paper sheet S in the direction in which the paper sheet S is conveyed, or the conveyance speed of the paper sheets S.

The configuration of each sensor P will be described next.

Figure 4:
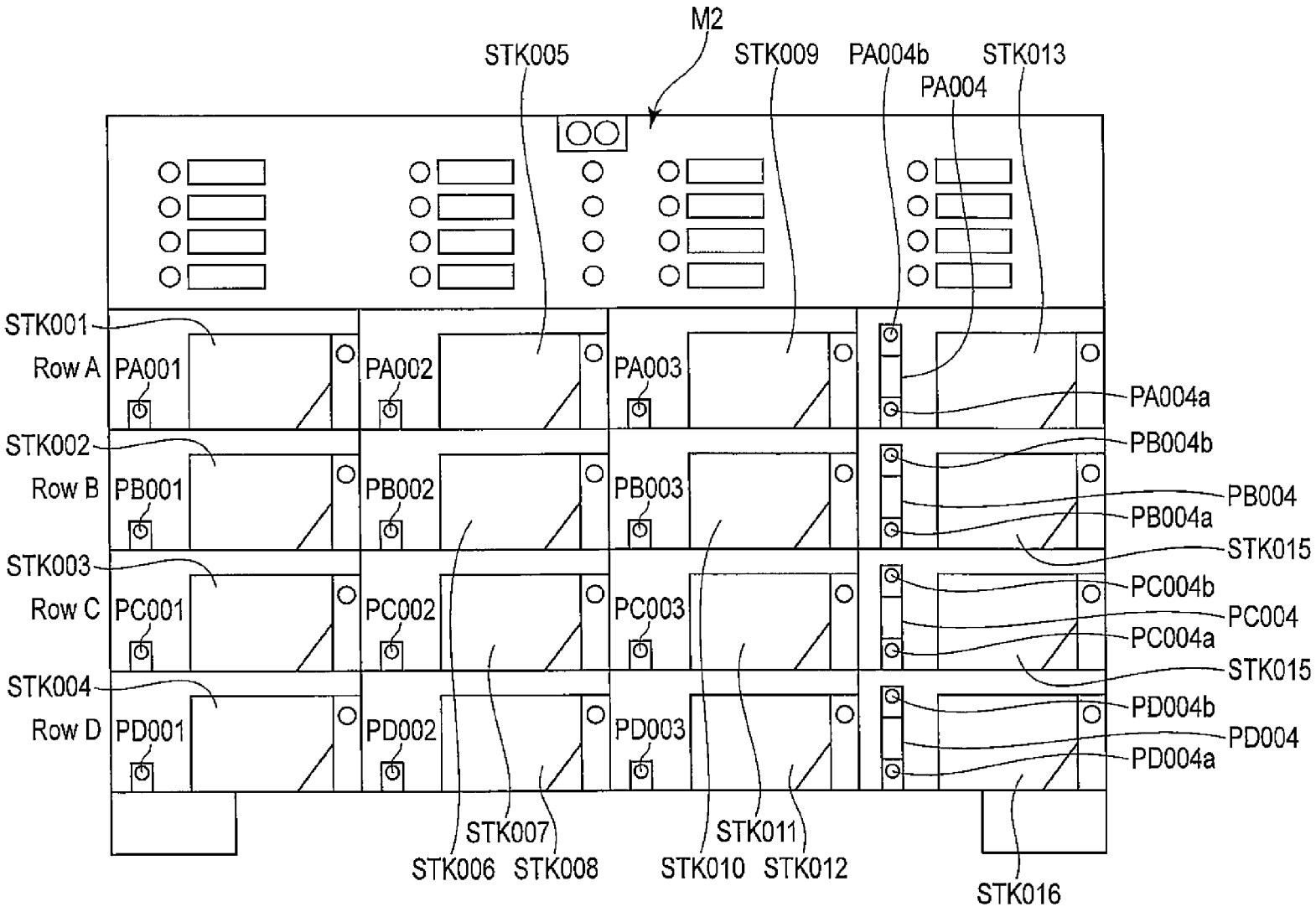
FIG. 4 is a view illustrating an example of the configuration of a module in the stacking unit.

FIG. 4 is a view illustrating a detailed example of the configuration of the module M2 in the stacking unit (paper sheet stacking apparatus) 20 shown in FIG. 3.

For example, the sensors PA001, PA002, PA003, and PA004 are arranged from the upstream side to the downstream side along the conveyance line 211 on row A of the module M2. Each of the sensors PA001, PA002, and PA003 is a shift sensor which detects the presence/absence of a paper sheet S. The sensor PA004 is a skew sensor which detects the skew of the paper sheet S. The conveyance line 211 includes the conveyor belt 211*a*. The conveyor belt 211*a* conveys the paper sheet S while it stands upright.

The shift sensors PA001 to PA003 detect the paper sheets conveyed on the conveyance line 211 on row A. In the configuration example shown in FIG. 4, one shift sensor PA001, one shift sensor PA002, and one shift sensor PA003 are arranged in the lower portions of the conveyor belt 211*a*. The shift sensors PA001 to PA003 need only be capable of detecting the paper sheets S conveyed on the conveyance line 211, and may be arranged in, for example, the upper portions of the conveyor belt 211*a*.

In the configuration example shown in FIG. 4, the skew sensor PA004 uses two shift sensors arranged in the upper and lower portions of the conveyor belt 211*a* which forms the conveyance line 211 on row A. The skew sensor PA004 uses the two shift sensors to detect the upper and lower portions of the leading edge of the paper sheet S conveyed on the conveyance line 211. In the skew sensor PA004 having the configuration shown in FIG. 4, the difference between the timing at which one shift sensor detects the leading edge of the paper sheet S and that at which the other shift sensor detects the leading edge of this paper sheet S represents the amount of skew. Note that each skew sensor may have another configuration as long as it can detect the amount of skew of the conveyed paper sheet S.

Also, in the module M2, sensors P are arranged on the conveyance line 212 on row B, the conveyance line 213 on row C, and the conveyance line 214 on row D in the same configuration as on the conveyance line 211 on row A. Note that FIG. 3 illustrates an example in which a paper sheet S2 is conveyed on the conveyance line 212 on row B, a paper sheet S3 is conveyed on the conveyance line 213 on row C, and a paper sheet S4 is conveyed on the conveyance line 214 on row D. In the module M2, the sensors PB004, PC004, and PD004 are skew sensors which detect the amounts of skew on rows B, C, and D, respectively.

The sorting control unit 201 receives a detection signal from each sensor P via the sensor interface 204. The sorting control unit 201 calculates the amount of skew (skew value) at the detection position of the skew sensor PA004 from, for example, the difference between the timings at which the two shift sensors which constitute the skew sensor PA004 detect the leading edge of the paper sheet S.

The sorting control unit 201 predicts the skew value on each row of the module M2 placed downstream of the module M1 in the direction in which the paper sheet S is conveyed, based on skew values calculated from the detection results obtained by the skew sensors PA004, PB004, PC004, and PD004 of the module M1.

The skew of the paper sheet S in the stacking unit 20 will be described next.

Figure 6:
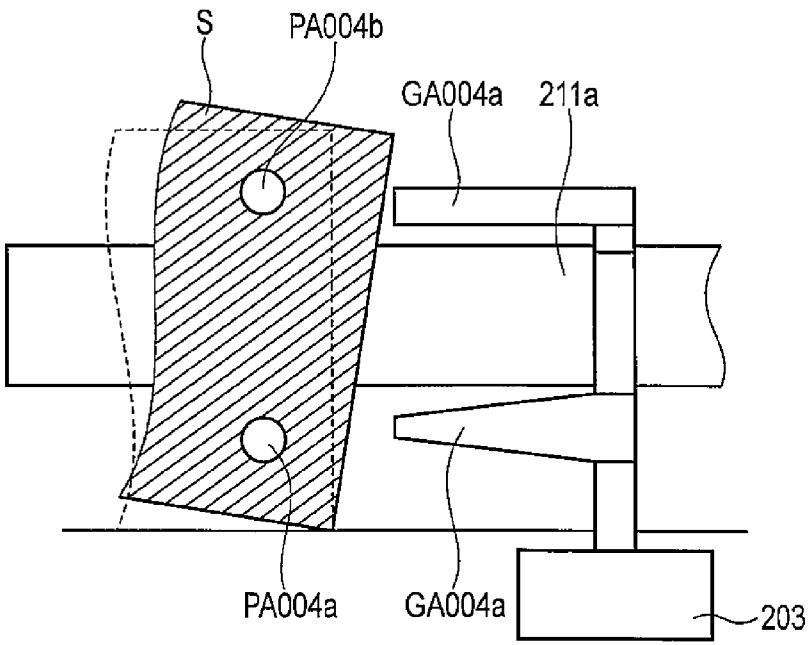
FIG. 6 is a view showing the conveyed state of a skewed paper sheet.
Figure 5:
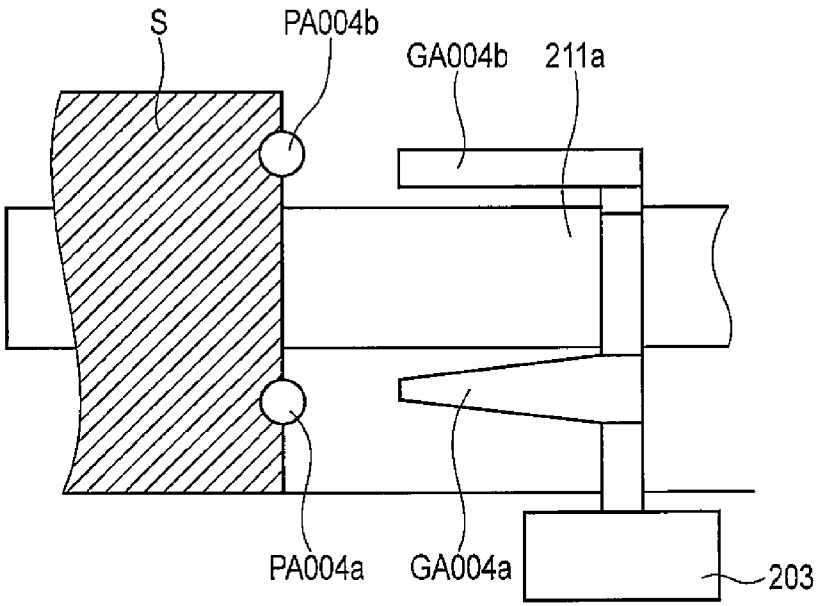
FIG. 5 is a view showing the conveyed state of a non-skewed paper sheet.
Figure 8:
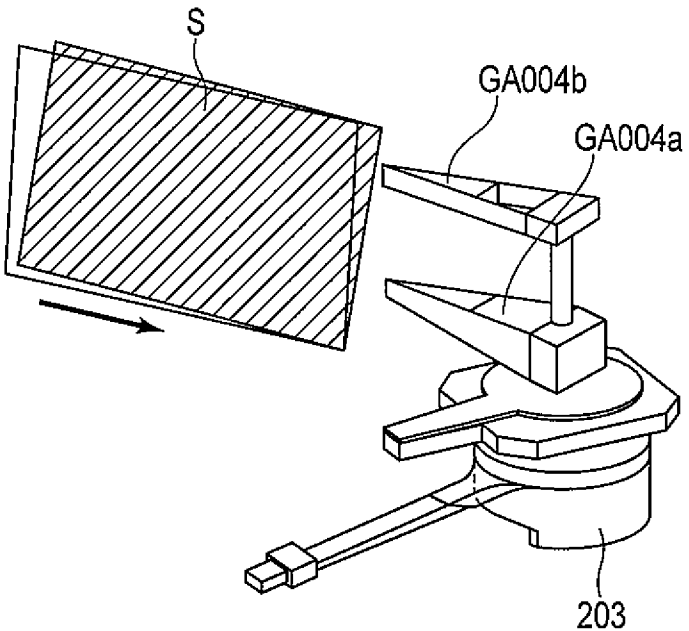
FIG. 8 is a view showing the relationship between gates and a skewed paper sheet.
Figure 7:
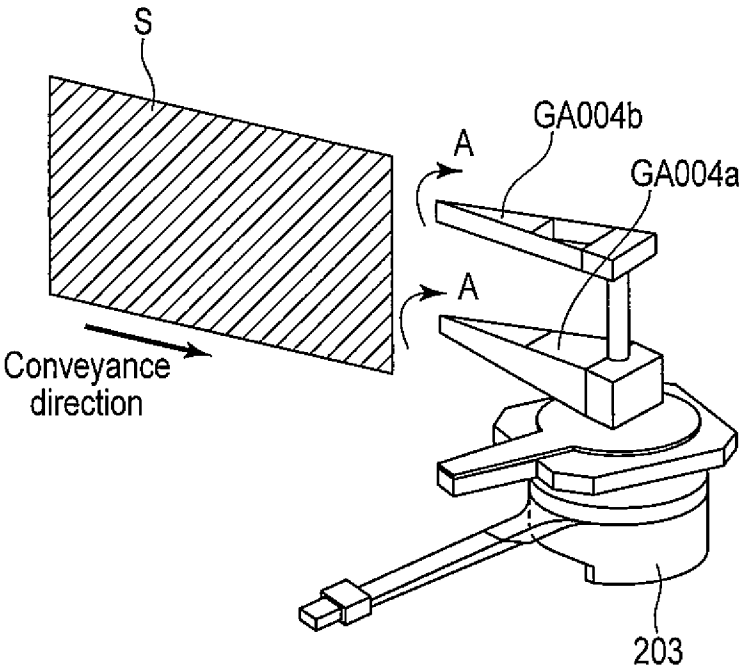
FIG. 7 is a view showing the relationship between gates and a non-skewed paper sheet.

FIGS. 5 and 6 are views showing the conveyed states of the paper sheets S in the row path 211 in the stacking unit 20. Also, FIGS. 7 and 8 are perspective views showing the relationships between the gates and the conveyed states of the paper sheets S. FIGS. 5 and 7 show the state in which the paper sheet S is conveyed in a non-skewed state. FIGS. 6 and 8 show the state in which the paper sheet S is conveyed in a skewed state. Note that in the configuration example shown in FIG. 3, the gate GA004 shown in FIGS. 5, 6, 7, and 8 guides the paper sheet S into the stacker STK001 of the next module.

Referring to FIGS. 5 and 6, the row path 211 includes the conveyor belt 211*a*. The gate GA004 includes gate members GA004*a* and GA004*b*. The gate members GA004*a* and GA004*b* are driven by the gate driving mechanism 203. In the configuration examples shown in FIGS. 5, 6, 7, and 8, the gate members GA004*a* and GA004*b* are connected to a rotating shaft rotated by the gate driving mechanism 203. The leading edges of the gate members GA004*a* and GA004*b* are aligned in a direction perpendicular to the direction in which the paper sheet S is conveyed along the row path 211.

The skew sensor PA004 includes shift sensors PA004*a* and PA004*b*. The shift sensors PA004*a* and PA004*b* which constitute the skew sensor PA004 are arranged upstream of the gate GA004 in the direction in which the paper sheet S is conveyed. Also, the shift sensors PA004*a* and PA004*b* are aligned in a direction perpendicular to the direction in which the paper sheet S is conveyed along the row path 211.

The skew sensor PA004 detects the amount of skew based on the difference between the timings at which the shift sensors PA004*a* and PA004*b* detect the leading edge of the paper sheet S. The amount of skew is calculated by, for example, counting the difference between the timings at which the shift sensors PA004*a* and PA004*b* detect the leading edge of the paper sheet S, based on a predetermined clock. Note that the method of detecting the skew of the paper sheet S in the row path is not limited to the skew sensor having the above-mentioned configuration.

As shown in FIGS. 5 and 7, if the paper sheet S is conveyed in a non-skewed state (the skew value falls within a tolerance), the leading edge of this paper sheet S reaches the gate members GA004*a* and GA004*b* almost simultaneously (the time difference falls within a predetermined range). In contrast to this, if the paper sheet S is conveyed in a skewed state, the leading edge of this paper sheet S reaches the gate members GA004*a* and GA004*b* at different timings. When the paper sheet S is conveyed in a skewed state, as shown in, for example, FIG. 6 or 8, the leading edge of this skewed paper sheet S reaches the upper gate member GA004*b* first, and reaches the lower gate member GA004*a* next.

In the configuration as shown in FIG. 4, shift sensors are arranged in the lower portions of the conveyor belt 211*a* which conveys the paper sheet S while it stands upright. While the paper sheet S is skewed, as shown in FIG. 6 or 8, the upper portion of this paper sheet S is conveyed first. Hence, conveyance control based on the timing at which the lower shift sensor detects the paper sheet often cannot normally convey the paper sheet skewed as shown in FIG. 6 or 8. When, for example, the gate members GA004*a* and GA004*b* are turned on with no concern for any skew, the paper sheet skewed as shown in FIG. 6 or 8 may collide against the gate member GA004*a*.

The stacking unit of the paper sheet processing apparatus according to this embodiment detects a skew value at least once using each module, and performs driving control of each module corresponding to the detected skew value. Also, in the stacking unit of the paper sheet processing apparatus according to this embodiment, a small number of skew sensors are arranged in each module (for example, one skew sensor is arranged for each row path) without arranging a large number of skew sensors in each row path. The stacking unit of the paper sheet processing apparatus according to this embodiment predicts the skew value at each point in the row path in accordance with the detection result obtained by the skew sensor, and ON/OFF-controls the corresponding gate in accordance with the predicted skew value. Upon this operation, the stacking unit of the paper sheet processing apparatus according to this embodiment can perform stable conveyance control corresponding to a skew while suppressing an increase in cost due to the arrangement of a large number of skew sensors.

Prediction of a skew at each point in the row path will be described next.

Figure 9:
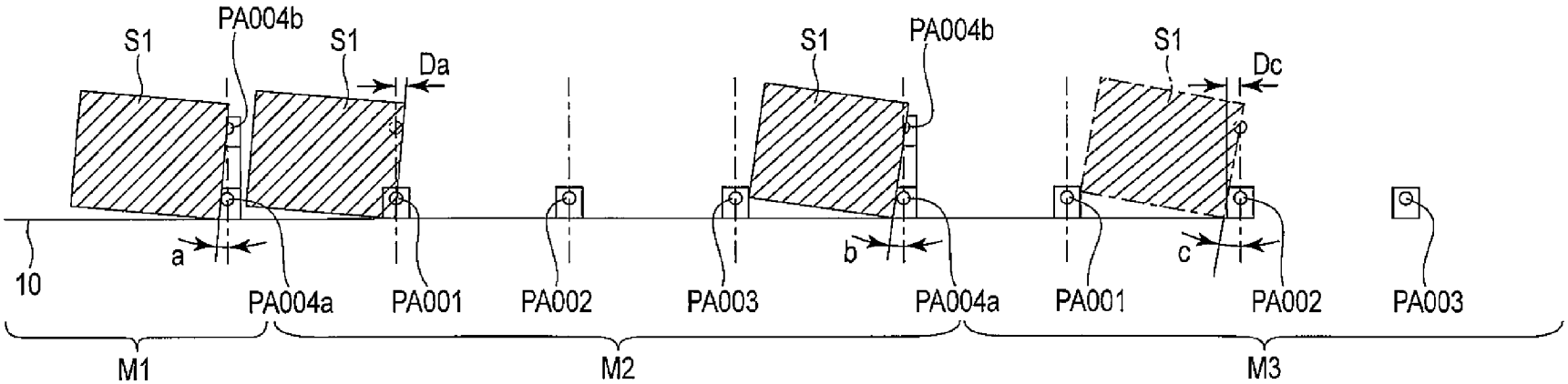
FIG. 9 is a view for explaining an example of the conveyed state and skewed state of a paper sheet.

FIG. 9 is a view for explaining the conveyed state and skewed state of the paper sheet.

In each module M of the configuration examples shown in FIGS. 3 and 4, a shift sensor or a skew sensor is placed in front of each gate. One skew sensor is placed in front of the most downstream gate in each row path in the module M. For example, the skew sensor PA004 is placed in the row path 211 on row A in the module M1. The row path 211 on row A is connected to the conveyance line 211 on row A of the module M1.

Also, in the configuration example shown in FIG. 9, each shift sensor detects the lower portion of the conveyor belt 211*a* which conveys a paper sheet S1 while it stands upright. The skew sensor uses a shift sensor which detects the lower portion of the conveyor belt 211*a*, and that which detects the upper portion of the conveyor belt 211*a*.

Assume that the skew sensor PA004 of the module M1 has detected a skew value a as the skew value of the paper sheet S1, as shown in FIG. 9. The sorting control unit 201 controls each gate in the module M2 at a timing set in consideration of, for example, the skew value a detected by the skew sensor PA004 of the module M1. That is, the sorting control unit 201 sets the time (enable timing), from when the shift sensor detects the leading edge of the paper sheet S1 in the downstream module M2 until the corresponding gate is driven, based on the skew value detected by the skew sensor in the upstream module M1.

For example, when the gate GA001 is to be driven (when the paper sheet S is to be stacked in the stacker corresponding to the gate GA001), the sorting control unit 201 drives the gate GA001 a time corresponding to the skew value a earlier than a normal enable timing (normal setting time) when the paper sheet S1 is not skewed, after the shift sensor PA001 of the module M2 detects the leading edge of the paper sheet S1. This is done because when the shift sensor PA001 detects the leading edge of the paper sheet S1, the upper end of the paper sheet S1 is expected to have already moved to the front by a distance Da corresponding to the skew value a in the direction in which the paper sheet S1 is conveyed. The sorting control unit 201 drives the gate GA001 a time corresponding to the skew value a earlier to avoid the paper sheet S1 from colliding against the gate GA001.

Also, when the gate GA002 is to be driven (when the paper sheet S is to be stacked in the stacker corresponding to the gate GA002), the sorting control unit 201 sets the time (enable timing), from when the shift sensor PA002 in the module M2 detects the leading edge of the paper sheet S1 until the gate GA002 is driven, to be a time corresponding to the skew value a earlier than the normal setting time.

When the gate GA003 is to be driven (when the paper sheet S is to be stacked in the stacker corresponding to the gate GA003), the sorting control unit 201 sets the time (enable timing), from when the shift sensor PA003 in the module M2 detects the leading edge of the paper sheet S1 until the gate GA003 is driven, to be a time corresponding to the skew value a earlier than the normal setting time.

When the gate GA004 is to be driven (when the paper sheet S is to be stacked in the stacker corresponding to the gate GA004), the sorting control unit 201 sets the time, from when the lower sensor PA004*a* in the sensor (skew sensor) PA004 in the module M2 detects the leading edge of the paper sheet S1 until the gate GA004 is driven, to be a time corresponding to the skew value a earlier than the normal setting time.

Note that FIG. 9 shows the skew of the paper sheet S1 when the upper end of the paper sheet S1 has moved to the front more than its lower end. In contrast to this, if the paper sheet S1 is skewed when the lower end of the paper sheet S1 has moved to the front more than its upper end, the sorting control unit 201 can drive the corresponding gate a time corresponding to the skew value a later than the normal setting time.

As described above, the sorting control unit sets the driving timing of each of the gates GA001 to GA004 in a downstream module (for example, the module M2) based on a skew value measured by a skew sensor placed in an upstream module (for example, the module M1) in the direction in which the paper sheet is conveyed. As a result, even if a paper sheet that is not skewed upon reception into the stacking unit is skewed during conveyance (even if the paper sheet is skewed in the course of conveyance along the conveyance path in the stacking unit), it is possible to avoid any problem due to the skew of the paper sheet, such as collision of the paper sheet against the gate.

As described above, the paper sheet processing apparatus includes a stacking unit (paper sheet stacking apparatus) which uses a plurality of modules each including a plurality of stackers. The stacking unit detects a skew value using a skew sensor placed in each conveyance path in each module. To receive a paper sheet into a stacker in a module placed downstream of a module which has detected a skew, the stacking unit enables a gate, which guides the paper sheet into a desired stacker, at a timing set in consideration of the skew value detected by an upstream module. This makes it possible to avoid any problem such as collision of the paper sheet against the gate even if a skew occurs in the conveyance system in the stacking unit, without arranging a large number of skew sensors corresponding to the respective stackers.

Gate control corresponding to a skew value detected in an upstream module in the direction in which the paper sheet is conveyed will be described next.

Figure 10:
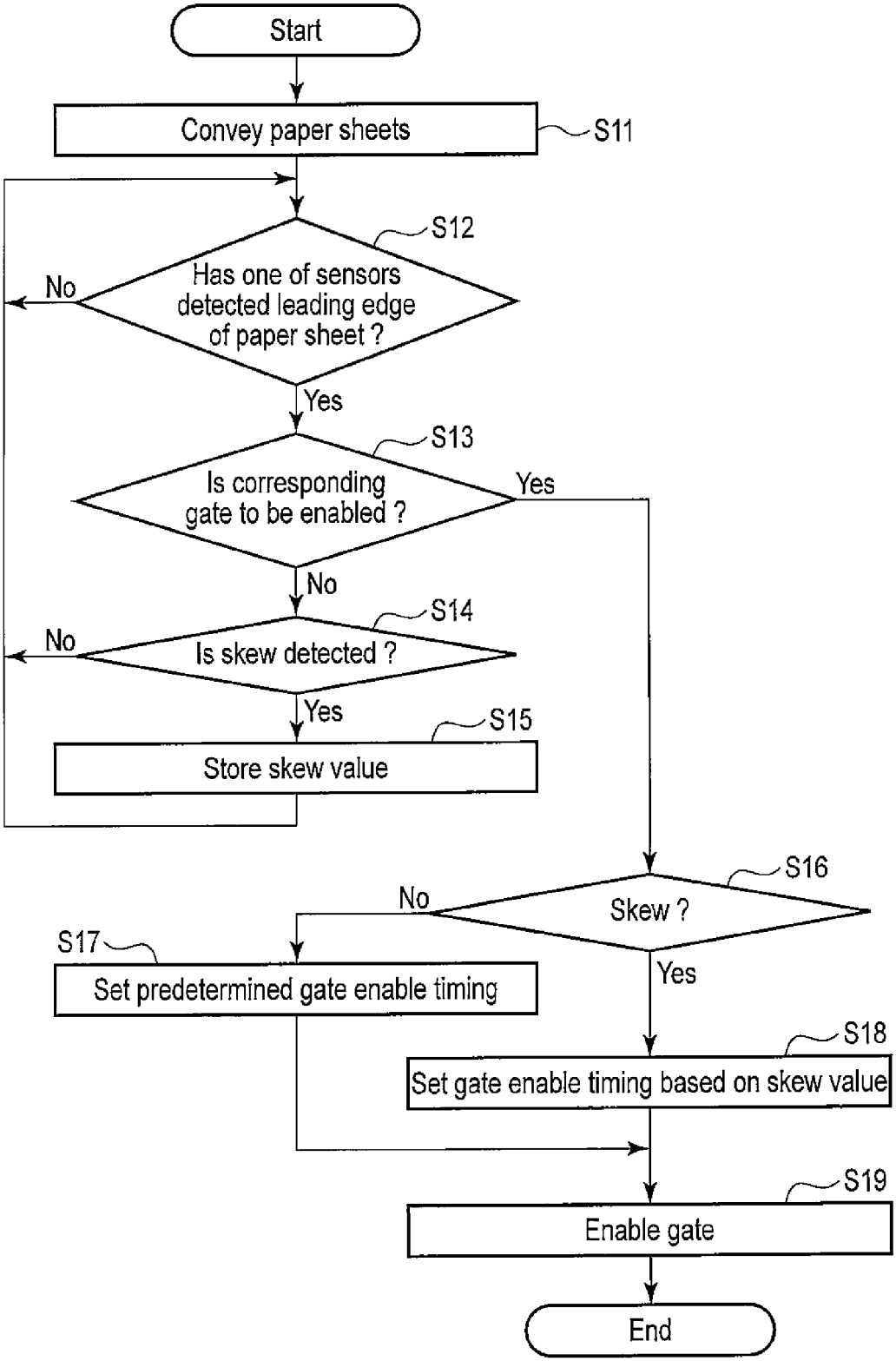
FIG. 10 is a flowchart for explaining an example of gate control corresponding to a detected skew value.

FIG. 10 is a flowchart for explaining an example of gate control under which each gate in a downstream module is controlled in accordance with a skew value detected by a skew sensor in an upstream module.

First, the stacking unit 20 receives paper sheets S to be stacked in stackers determined based on their sorting information. The sorting control unit 201 conveys the paper sheets S received by the stacking unit 20 along the row paths in each module (step S11). The sorting control unit 201 determines whether one of the sensors P in each row path has detected the leading edge of the paper sheet S, based on detection signals received from these sensors (S12).

If one of the sensors P in each row path has detected the leading edge of the paper sheet S (YES in step S12), the sorting control unit 201 determines whether the gate G corresponding to the sensor P that has detected the leading edge of the paper sheet S is to be enabled (step S13). This means that the sorting control unit 201 determines whether the paper sheet S is to be stacked in the stacker STK corresponding to the sensor P and gate G.

If the gate G is not to be enabled (NO in step S13), the sorting control unit 201 determines whether the sensor P that has detected the leading edge of the paper sheet S is a skew sensor (step S14). If it is determined that the sensor P that has detected the leading edge of the paper sheet S is a skew sensor (YES in step S14), the sorting control unit 201 stores a skew value detected by this skew sensor in the memory 201*a* (step S15).

The skew value stored in the memory 201*a* may be a value indicating the difference between the detection timings at which the two shift sensors which constitute the skew sensor have detected the leading edge of the paper sheet S, or may be an angle indicating a skew value calculated from a detection signal detected by the skew sensor. The sorting control unit 201 that has stored the skew value in the memory 201*a* returns the process to the above-mentioned step S12, and waits until the next sensor P detects the paper sheet S.

On the other hand, if it is determined that the gate G is to be enabled (YES in step S13), the sorting control unit 201 determines whether the paper sheet S having its leading edge detected is skewed (step S16). The sorting control unit 201 determines whether the paper sheet S is skewed, based on whether a skew value according to which it is determined that the paper sheet S is skewed is stored in the memory 201*a*.

If it is determined that the paper sheet S is not skewed (NO in step S16), the sorting control unit 201 sets a normal setting time as the enable timing of the gate G (step S17). The normal setting time means the time (normal enable timing) from when the sensor P detects the leading edge of a non-skewed paper sheet S until the corresponding gate G is enabled.

If it is determined that the paper sheet S is skewed (YES in step S16), the sorting control unit 201 sets (adjusts) the enable timing of the gate G corresponding to the sensor P in accordance with the skew value of the paper sheet S, which is stored in the memory 201*a* (step S18). As shown in, for example, FIG. 9, when the paper sheet S is skewed while its upper portion has moved to the front more than its lower portion, the sorting control unit 201 sets the enable timing of the gate G so that the gate G is enabled earlier than the normal setting time.

When the enable timing of the gate G is set in step S17 or S18, the sorting control unit 201 performs control to enable the gate G in accordance with the set enable timing of the gate G (step S19).

Upon the above-mentioned process, the paper sheet S is received into a desired stacker by the gate driven at a timing corresponding to the skew value detected by the upstream module.

As described above, the sorting control unit sets the driving timing of each of the gates GA001 to GA004 in a downstream module (for example, the module M2) based on a skew value measured by a skew sensor placed at the terminal end of an upstream module (for example, the module M1) in the direction in which the paper sheet is conveyed. As a result, even if a paper sheet that is not skewed upon reception into the stacking unit is skewed during conveyance (even if the paper sheet is skewed in the course of conveyance along the conveyance path in the stacking unit), it is possible to avoid any problem due to the skew of the paper sheet, such as collision of the paper sheet against the gate.

Gate control based on a skew value predicted from a plurality of detection results will be described next.

When a plurality of skew sensors are placed upstream in the direction in which the paper sheet S is conveyed, the sorting control unit 201 may predict the skew value in front of each gate based on a plurality of skew values detected by these skew sensors. That is, as long as the skew value of the paper sheet S in the stacking unit 20 changes depending on a specific function, the sorting control unit 201 can predict the skew value of the paper sheet S at each position on the downstream side using a plurality of skew values at a plurality of positions in the conveyance path.

Assume, for example, that the paper sheet S1 is stacked in a stacker in the module M3 shown in FIG. 9. In the example shown in FIG. 9, the skew sensor PA004 of the module M1 detects a skew value a of the paper sheet S1, and the skew sensor PA004 of the module M2 detects a skew value b (b>a). FIG. 9 illustrates an example in which the skew value gradually changes while a paper sheet S1 is conveyed in each module in the stacking unit 20 serving as a paper sheet stacking apparatus. Also, in the example shown in FIG. 9, the skew value of the paper sheet S1 in the stacking unit 20 is predicted based on a predetermined function that uses, for example, linear approximation.

That is, even a paper sheet that is not skewed upon supply into the stacking unit 20 (a paper sheet having a skew value that falls within a tolerance within which it can be stacked in a stacker) may be skewed to the degree that its skew value falls outside the tolerance in the course of conveyance in the stacking unit 20. If no skew sensor is present in the conveyance path in the stacking unit 20, it may be impossible to detect the fact that the skew value falls outside the tolerance, thus causing a problem such as degradation in stacked state or collision of the paper sheet against the gate. In contrast to this, the stacking unit 20 according to this embodiment detects a skew at least once by each module to predict the skew value in a downstream module.

A method of calculating a predicted skew value c will be described herein assuming the example shown in FIG. 9.

First, in the module M1, the skew sensor PA004 detects a skew value a of the paper sheet S. The sorting control unit 201 stores the skew value a, detected by the skew sensor PA004 of the module M1, in the memory 201*a* in association with the identification information of the paper sheet S. In the next module M2, the skew sensor PA004 detects a skew value b of the skew sensor PA004. The sorting control unit 201 stores the skew value b, detected by the skew sensor PA004 of the module M2, in the memory 201*a* in association with the identification information of the paper sheet S.

When skew values at a plurality of upstream positions are stored in the memory 201*a*, the sorting control unit 201 calculates the predicted skew value of the paper sheet S in a downstream module. In the example shown in FIG. 9, the sorting control unit 201 calculates a predicted skew value c of the paper sheet S in the module M3 from the skew value a obtained by the first module M1 and the skew value b obtained by the second module M2. The skew value of the paper sheet S in the stacking unit 20 changes depending on a predetermined function that uses, for example, linear approximation. In this case, the sorting control unit 201 substitutes the two skew values a and b detected by the modules M1 and M2, respectively, into the predetermined function that uses, for example, linear approximation to calculate the predicted skew value in each shift sensor in the module M3.

When the skew value is predicted by, for example, linear approximation, the sorting control unit 201 serving as a calculation unit calculates the predicted skew value in each shift sensor in the module M3 in accordance with:

$$\text{for } a<b, c=b+(|a-b|/N)*N \quad (1)$$

$$\text{for } a>b, c=b-(|a-b|/N)*N \quad (2)$$

where a is the skew value detected by the skew sensor in a module (the module M1 in the example shown in FIG. 9) second preceding the target module, b is the skew value detected by the skew sensor in a module (the module M2 in the example shown in FIG. 9) immediately preceding the target module, c is the predicted skew value in the target sensor (the shift sensor PA002 of the module M3 in the example shown in FIG. 9), N is the total number of sensors in each row path in each module (N=4 in the example shown in FIG. 9), and n is the order of arrangement of sensors in each module and is determined as n=1 when the first sensor (shift sensor PA001) is the target, n=2 when the second sensor (shift sensor PA002) is the target, n=3 when the third sensor (shift sensor PA003) is the target, and n=4 when the fourth sensor (shift sensor PA004) is the target.

Assume, for example, that the skew value a detected by the module M1 is "1", and the skew value b detected by the module M2 is "3°". This means that for "a=1" and "b=3", the predicted skew value c obtained by the shift sensor PA002 of the module M3 is calculated in accordance with the above-mentioned calculation equation (1) as: c=3+(2/4)*2=4°

Also, for a<b, the upper end of the paper sheet S is expected to have moved to the front in the direction, in which the paper sheet S is conveyed, by a distance Dc corresponding to the predicted skew value c calculated in accordance with the above-mentioned calculation equation.

Moreover, to perform normal gate control, a tolerance may be set for the skew of the paper sheet S. In this case, if the calculated, predicted skew value falls outside the tolerance, the sorting control unit 201 does not drive the corresponding gate G. This is because a problem is expected to occur when a paper sheet S skewed to the degree that its predicted skew value falls outside the tolerance is guided into the stacker by the gate G. When the skew tolerance is set to, for example, 3°, and the calculated, predicted skew value is 4°, the gate GA002 corresponding to the shift sensor PA002 of the module M3 is not driven to convey the paper sheet S1. In this case, the paper sheet S1 is not conveyed into the stacker corresponding to the gate GA002, and therefore neither collides against the gate nor is stacked in the corresponding stacker in an inappropriate state.

Note that a paper sheet expected to be skewed to the degree that its predicted skew value falls outside the tolerance may be conveyed and stacked in a rejection stacker placed at, for example, the terminal end of each module, instead of stacking it into the stacker corresponding to the gate G (for example, the gate GA002).

On the other hand, if the calculated, predicted skew value c falls within the skew tolerance, the sorting control unit 201 drives the gate GA002 at an enable timing corresponding to the predicted skew value c after the paper sheet S reaches the shift sensor PA002 of the module M3. Also, when the skew value a of the paper sheet S obtained by the module M1 is 4°, and the skew value b of the paper sheet S obtained by the module M2 is 3°, the predicted skew value c in the shift sensor PA002 of the module M3 is calculated as 2.5° in accordance with the above-mentioned calculation equation. In this case, when the skew tolerance is 3°, the sorting control unit 201 enables the gate GA002 corresponding to the shift sensor PA002. As a result, the paper sheet S is stacked in the stacker corresponding to the gate GA002.

Note that in the above-mentioned example, the method of calculating a predicted skew value from a plurality of skew values is not limited to calculation by linear approximation (linear function). That is, all methods of calculating a predicted skew value from a plurality of skew values can be adopted as long as they serve to calculate a predicted skew value using a predetermined function.

As described above, when a paper sheet is stacked in each module, the sorting control unit calculates the predicted skew value in front of a gate which guides the paper sheet into a desired stacker in which the paper sheet is to be stacked, based on a plurality of skew values detected by an upstream skew sensor. The sorting control unit controls the enable timing of a gate which guides the paper sheet, in accordance with the calculated, predicted skew value. Upon this operation, the stacking unit can reliably convey the paper sheets and efficiently control the gates without wasting time. This makes it possible to downsize the stacking unit serving as a paper sheet stacking apparatus.

Gate control corresponding to a plurality of skew values on the upstream side will be described next.

Figure 11:
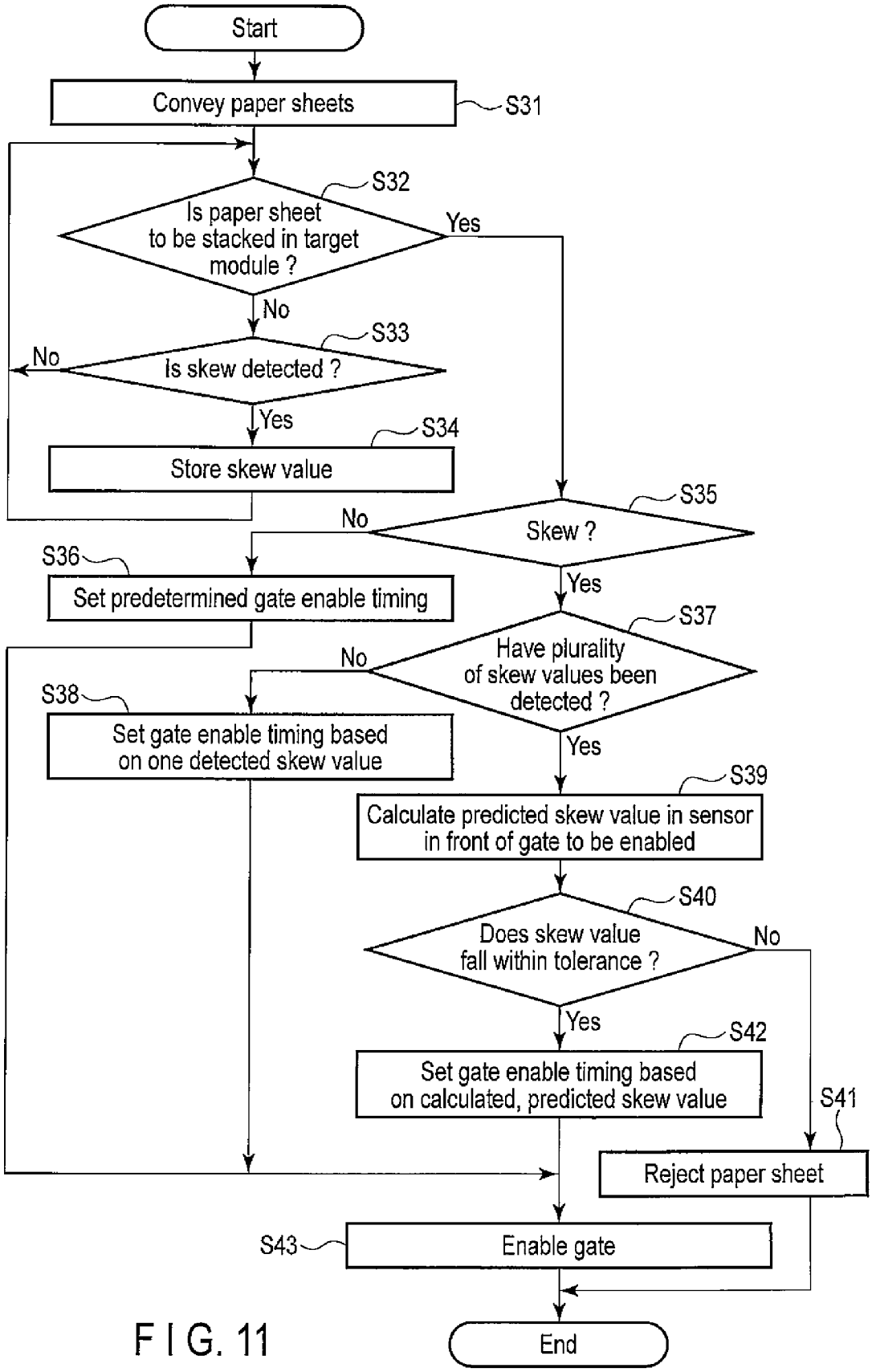
FIG. 11 is a flowchart for explaining an example of gate control based on a predicted skew value calculated from a plurality of skew values.

FIG. 11 is a flowchart for explaining an example of a process of controlling each gate in accordance with a skew value predicted form a plurality of skew values detected on the upstream side.

First, the stacking unit 20 receives paper sheets S to be stacked in stackers determined based on their sorting information. The sorting control unit 201 conveys the paper sheets S to each module along the row paths into which the paper sheets S are sorted by the branching unit 19 (step S31). In supplying a paper sheet S to the module M, the sorting control unit 201 determines whether the paper sheet S is to be stacked in a stacker in the module M (step S32).

If it is determined that the paper sheet S is not to be stacked in a stacker in the module M (NO in step S32), the sorting control unit 201 determines whether the skew sensor P has detected the skew value of the paper sheet S in the module M (step S33). If the skew sensor P has detected the skew value of the paper sheet S (YES in step S33), the sorting control unit 201 stores the skew value, detected by the skew sensor P, in the memory 201*a* in association with identification information indicating the paper sheet S (step S34).

The skew value stored in the memory 201*a* may be a value indicating the difference between the detection timings at which the two shift sensors which constitute the skew sensor have detected the leading edge of the paper sheet S, or may be an angle indicating a skew value calculated from a detection signal detected by the skew sensor. When the predicted skew value is calculated by, for example, the above-mentioned calculation equation, the memory 201*a* stores an angle as the skew value of the paper sheet S.

If it is determined that the paper sheet S is to be stacked in a stacker in the module M (YES in step S32), the sorting control unit 201 determines whether the paper sheet S is skewed (step S35). The sorting control unit 201 determines whether the paper sheet S is skewed, based on the skew value stored in the memory 201*a* in association with the paper sheet S.

If it is determined that the paper sheet S is not skewed (NO in step S35), the sorting control unit 201 sets a normal setting time as the enable timing of the gate G corresponding to the stacker in which the paper sheet S is to be stacked (step S36). The normal setting time means the time (normal enable timing) from when the sensor P detects the leading edge of a non-skewed paper sheet S until the corresponding gate G is enabled.

If it is determined that the paper sheet S is skewed (YES in step S35), the sorting control unit 201 determines whether a plurality of skew values associated with the paper sheet S are stored in the memory 201*a* (step S37). If a plurality of skew values associated with the paper sheet S are not stored, that is, a single skew value is stored in the memory 201*a* in association with the paper sheet S (NO in step S37), the sorting control unit 201 sets (adjusts) the enable timing of the gate G corresponding to the stacker, in which the paper sheet S is to be stacked, in accordance with the single skew value stored in the memory 201*a* (step S38).

If a plurality of skew values are stored in the memory 201*a* in association with the paper sheet S (YES in step S37), the sorting control unit 201 calculates the predicted skew value in front of the gate G (the detection position of the sensor corresponding to the gate G) corresponding to the stacker in which the paper sheet S is stacked (step S39). The sorting control unit 201 serving as a calculation unit calculates the predicted skew value using a preset function such as the above-mentioned calculation equation (1). After the predicted skew value is calculated, the sorting control unit 201 determines whether the calculated, predicted skew value falls within the skew tolerance (step S40).

If it is determined that the calculated, predicted skew value falls outside the skew tolerance (NO in step S40), the sorting control unit 201 performs a process of rejecting the paper sheet S without driving the gate G (step S41).

On the other hand, if it is determined that the calculated, predicted skew value falls within the skew tolerance (YES in step S40), the sorting control unit 201 sets (adjusts) the enable timing of the gate G corresponding to the stacker, in which the paper sheet S is to be stacked, in accordance with the calculated, predicted skew value (step S42).

When the enable timing of the gate G is set in step S36, S38, or S42, the sorting control unit 201 performs control to enable the gate G in accordance with the set enable timing of the gate G (step S43). Upon this operation, the paper sheet S is guided from the gate G into a desired stacker and stacked in it.

As described above, the sorting control unit predicts the skew value of a paper sheet in a sensor corresponding to a gate placed at the entrance to a stacker in which the paper sheet is to be stacked, based on the skew value of the paper sheet detected by the second next module to a module including the stacker in which the paper sheet is to be stacked, and that of the paper sheet detected by a module immediately next to the module including that stacker. The sorting control unit enables a gate corresponding to that stacker based on the predicted skew value. Upon this operation, the stacking unit can reduce any problem caused by collision of the paper sheet against the driven gate or stacking of the skewed paper sheet.

Also, before the leading edge of the paper sheet reaches the detection position of each sensor, it can be determined whether the skew of a paper sheet falls within a tolerance. Hence, the distance between each gate and sensor placed at the entrance of a stacker in which the paper sheet is to be stacked can be set to a minimum distance at which the gate can be reliably driven. This makes it possible to downsize each module which constitutes the stacking unit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet stacking apparatus comprising:

a conveyance path which conveys sheets;

a plurality of stackers which stack the sheets;

a plurality of gates which are arranged in a number corresponding to the number of stackers and which guide the sheets from the conveyance path into the stackers, respectively;

a skew sensor which detects a skew of the sheet conveyed along the conveyance path; and a calculation unit which calculates a predicted skew value when the sheet reaches the gate corresponding to the stacker in which the sheet is to be stacked, based on the skew of the sheet detected by the skew sensor upstream of the gate corresponding to the stacker in which the sheet is to be stacked;

a control unit which controls driving of the gate corresponding to the stacker in which the sheet is to be stacked, based on the predicted skew value calculated by the calculating unit.

2. The apparatus according to claim 1, further comprising: a plurality of shift sensors which detect the sheet on upstream sides of the respective gates in the conveyance path, wherein the control unit controls driving of the gate corresponding to the stacker in which the sheet is to be stacked, based on a timing at which the shift sensor has detected a leading edge of the sheet on an upstream side of the gate corresponding to the stacker in which the sheet is to be stacked, and the predicted skew value calculated by the calculation unit.

3. The apparatus according to claim 1, wherein the skew sensor also functions as the shift sensor and is placed upstream of each of some gates of the plurality of gates.

4. The apparatus according to claim 1, wherein a calculation unit calculates a predicted skew value when the sheet reaches the gate corresponding to the stacker in which the sheet is to be stacked, based on a plurality of skew values of the sheet detected by the skew sensor at a plurality of positions upstream of the gate corresponding to the stacker in which the sheet is to be stacked.

5. The apparatus according to claim 4, wherein the calculation unit calculates the predicted skew value using a predetermined calculation scheme.

6. The apparatus according to claim 5, wherein the predetermined calculation scheme is used to calculate the predicted skew value by linearly approximating the plurality of skew values.

7. The apparatus according to claim 1, further comprising:

a plurality of modules each of which comprises the conveyance path, the plurality of stackers, the plurality of gates, and the skew sensor, and which are sequentially connected to the conveyance path, wherein the calculation unit calculates a predicted skew value when the sheet reaches the gate corresponding to the stacker in which the sheet is to be stacked, based on a skew value of the sheet detected by the skew sensor of a module upstream of a module including the stacker, in which the sheet is to be stacked, in the direction in which the sheet is conveyed.

8. The apparatus according to claim 7, wherein each of the modules includes a plurality of shift sensors which detect the sheets on upstream sides of the respective gates in the conveyance path, and the control unit controls driving of the gate corresponding to the stacker in which the sheet is to be stacked, based on a timing at which the shift sensor has detected a leading edge of the sheet on an upstream side of the gate corresponding to the stacker in which the sheet is to be stacked, and the predicted skew value calculated by the calculation unit.

9. The apparatus according to claim 8, wherein the skew sensor also functions as the shift sensor and is placed upstream of one gate of a plurality of gates arranged in one conveyance path of each module.

10. The apparatus according to claim 7, wherein a calculation unit calculates a predicted skew value when the sheet reaches the gate corresponding to the stacker in which the sheet is to be stacked, based on a plurality of skew values of the sheet detected by the skew sensors in a plurality of modules upstream of the module including the stacker in which the sheet is to be stacked.

11. The apparatus according to claim 10, wherein the calculation unit calculates the predicted skew value using a predetermined calculation scheme.

12. The apparatus according to claim 11, wherein the predetermined calculation scheme is used to calculate the predicted skew value by linearly approximating the plurality of skew values.

13. A sheet stacking apparatus comprising:

a conveyance path which conveys sheets;

a plurality of stackers which stack the sheets;

a plurality of gates, the plurality of gates respectively corresponding to the plurality of stackers, and each gate guiding selected sheets from the conveyance path into the corresponding stacker;

a skew sensor arranged along the conveyance path at a location upstream and at a distance from at least one gate of the plurality of gates and the stacker corresponding to the one gate, the skew sensor respectively detecting skews of the sheets conveyed along the conveyance path;

a calculation unit calculating a predicted skew value for each sheet when each sheet reaches the one gate and the corresponding stacker in which the selected sheets are to be stacked, based on the skew for each sheet detected by the skew sensor; and a control unit driving the one gate corresponding to the stacker in which the selected sheets are to be stacked, based on the predicted skew value for each sheet calculated by the calculating unit.

* * * * *